United States Patent [19]

Williams

[11] 3,941,018

[45] Mar. 2, 1976

[54] BOARD CUTTING MACHINE

[75] Inventor: Jimmy L. Williams, Houston, Tex.

[73] Assignee: Glass Master Corporation, San Antonio, Tex.

[22] Filed: Dec. 23, 1974

[21] Appl. No.: 535,176

[52] U.S. Cl. ..... 83/5; 144/136 R; 83/422; 83/436

[51] Int. Cl.[2] ..... B26D 3/06; B27F 5/02

[58] Field of Search ..... 83/5, 1, 422, 436; 144/136 R, 133 R, 245 F; 90/16

[56] References Cited

UNITED STATES PATENTS

| | | | |
|---|---|---|---|
| 3,605,534 | 9/1971 | Barr | 83/5 |
| 3,863,530 | 2/1975 | Weidman | 83/5 |
| 3,875,835 | 4/1975 | Roberts | 83/5 |

*Primary Examiner*—Donald R. Schran
*Attorney, Agent, or Firm*—Vinson, Elkins, Searls, Connally & Smith

[57] ABSTRACT

A machine for cutting fiberglass board of the type having an impermeable barrier, such as foil, on one face thereof. As a board of fiberglass moves through the machine, the leading edge of the foil is bent down from it normal plane of travel so that a knife edge which is below this plane of travel will be inserted between the foil and remainder of the board.

The board is then maintained in its normal plane of travel and the knife edge being below the board forces the barrier to shear away from the board as the board passes through the machine. The knife edge cleans the loosened foil to remove most of the insulation material that might remain adhered thereto.

6 Claims, 4 Drawing Figures

BOARD CUTTING MACHINE

This invention relates to insulation board cutting machines and more particularly to machines for cutting board of the type which has an impermeable barrier such as foil on one face thereof.

Insulation board made of matted fiberglass held together with a suitable binder and having a barrier on one face thereof such as of aluminum foil, is normally shipped from the point of manufacture to other points about the country for processing. During shipment and handling, it frequently ocurrs that the edges of the board are bent or damaged. In the past, it has been necessary when utilizing board cutting machines, to scrap the portion of a board damaged because the foil has tended to hang on the cutting knife and ball up against the knife instead of passing under the knife during the process of cutting the insulation material free from the foil. Board cutting machines such as that disclosed in Barr U.S. Pat. No. 3,605,534, which is incorporated herein by reference, operates in a manner to move the foil between a knife edge and a support roller. Where the board has been bent at an edge and the foil is not smooth, the foil will tend to roll up in front of the knife and thus, such boards cannot be utilized fully and the damaged section has frequently been removed and scrapped.

It is an object of this invention to provide a board cutting machine and method which is capable of removing strips of insulating material from an insulating board without damage to the impermerable barrier on the face thereof, even though the ends or edges of the board may have been damaged prior to being run through the machine.

In complex cuts such as some of those shown in the Barr Patent, it is customary to use a pair of blades, one positioned behind the other. With the front blade immediately above a support roller, a cut can be made very close to the foils. However, the second blade has been spaced behind the roller and it has been found that this cut is not as close as that made by the front blade. It results that in some type of cuts the matted fiberglass is not entirely cleaned off of the foil and a thin layer may be left.

It is an object of this invention to provide a cutting machine and method in which blades may be arranged in tandem with one of the blades cutting above the support roller as in Barr, or both of the blades cutting between a pair of supports such as rollers in which substantially all of the matted fiberglass is cut free from the facing.

Another object is to provide a method of removing a strip of insulating material from an insulating board in which the barrier is bent so that it will go under the knife and thereafter the knife acts to shear the foil from the fiberglass which is held in its original unbent condition.

Other objects, features and advantages of this invention will be apparent from the drawings, specification and the claims.

In the drawings wherein like numerals represent like parts and wherein an illustrative embodiment of this invention is shown:

Figure 1:
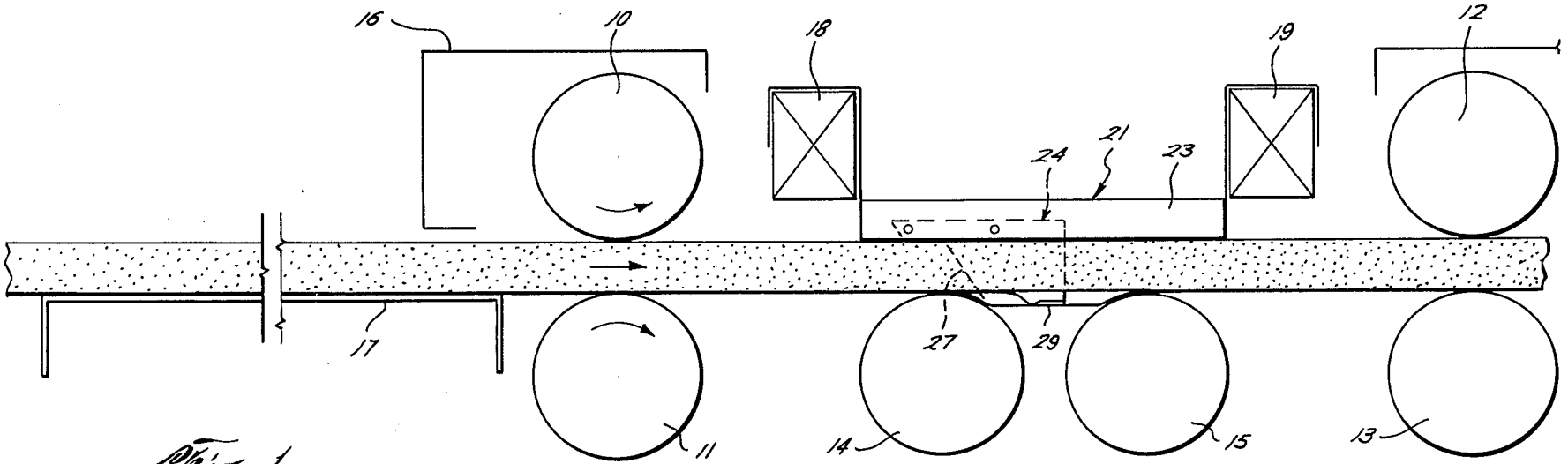
FIG. 1 is a schematic view of a machine constructed in accordance with this invention.

Reference is made to the above identified Barr Patent for a complete disclosure of a board cutting machine and the type of cuts which are made thereby. This invention is in the nature of an improvement in the Barr Patent and only so much of the machine as has been modified are shown in the drawings.

Four rollers 10, 11, 12 and 13 act as drive rollers to receive a board of insulating material therebetween and drive the board through the machine from left to right as viewed in FIG. 1. The board is slightly pinched between rollers 10 and 11 and between 12 and 13, to provide a good purchase of these rollers against the board.

A supporting means is provided to support the board while it is being cut. Preferably, this means is provided by a pair of support rollers 14 and 15 which are arranged between the two pair of drive rollers and are spaced slightly from each other. Suitable guards such as guard 16 may be provided over the rollers to protect personnel. Also, a platform 17 may be provided at the front or feed end of the machine to support the board and guide it into the space between the feed rollers 10 and 11 as it is started into the machine.

As will be apparent from the Barr patent, a plurality of cutting means are provided for cutting each board and as these are ajustable for cuts at different lengths from the base end of the board, the cutting means is mounted on a structure which will permit it to be moved across the machine. In the illustrative embodiment, a pair of box beams 18 and 19 extend across the machine between the top drive rollers 10 and 12 and provide a means for positioning the cutter blades at selective points across the board being cut. The manner of connecting the blade support indicated generally at 21 to the two box beams 18 and 19 as well as the particular configuration or construction of the blade support means 21 form no part of this invention and their details are now shown. It suffices to say that the blade support 21 may be of any configuration and is held in a selected position between the box beams 18 and 19 by any desired clamping structure.

While the preferred form of machine positions the blade support and blade above the support rollers 15, it will be appreciated that the machine could be oriented in any desired manner. In any event, the blade carrier is positioned on the opposite side from the work support means such as rollers 14 and 15 from a plane which represents the work surface. Such a plane would be tangent to both rollers 14 and 15 and in the form of machine illustrated would be tangent to the crest of support rollers 14 and 15.

It is preferred that some means be provided for snugly holding the board being processed against the support rollers 14 and 15, in the vacinity of the cut. For this purpose, the blade support means 21 may be provided with a pair of spaced sleds 22 and 23 against which the board bears as it moves through the machine. It will be noted from FIG. 4 that the blade means indicated generally at 24 is positioned between the two sleds 22 and 23 and, thus, the board is supported against the rollers on both sides of the blade means.

The blade means 24 which is supported from the blade support means 21 may take any desired configuration. As shown in the Barr patent, different configurations are utilized to make different cuts and sometimes two blades are utilized to make the desired cut.

Figure 4:
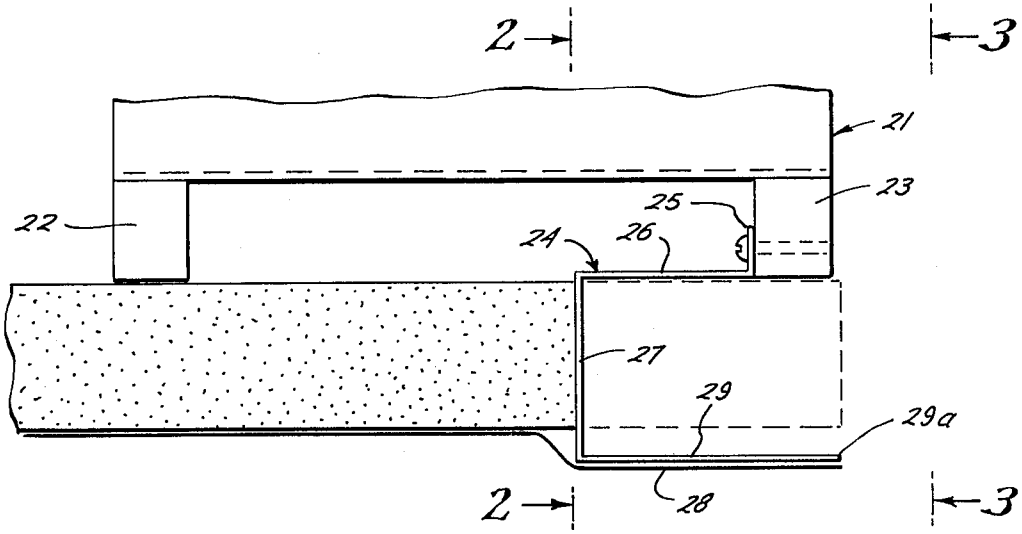
FIG. 4 is a fragmentary front view of the knife carrier and knife illustrating the manner in which sleds on the bottom of the knife carrier hold the board down against the support means such as the rollers illustrated.

In the blade illustrated in FIG. 4, an upstanding flange 25 is provided which may be secured to the sled 23 in any desired manner, such as by bolts. The upper horizontal run 26 of this blade is non-cutting and it will be noted that it is above the board being cut and functions as a support for the remainder of the blade.

For cutting purposes, the blade means has a first cutting edge 27 which extends downwardly from blade section 26 past said tangential plane and into the space between the support means provided by rollers 14 and 15. Thus, this first cutting edge extends from above the board being cut downwardly to a point below the board as it passes over support rollers 14 and 15 and cuts through the entire section of insulating material, which is normally matted fiberglass with a suitable binder. As will be explained hereinbelow, this blade does not cut through the foil or other impervious membrane 28 which is adhered to the fiberglass material of the remainder of the board.

Figure 2:
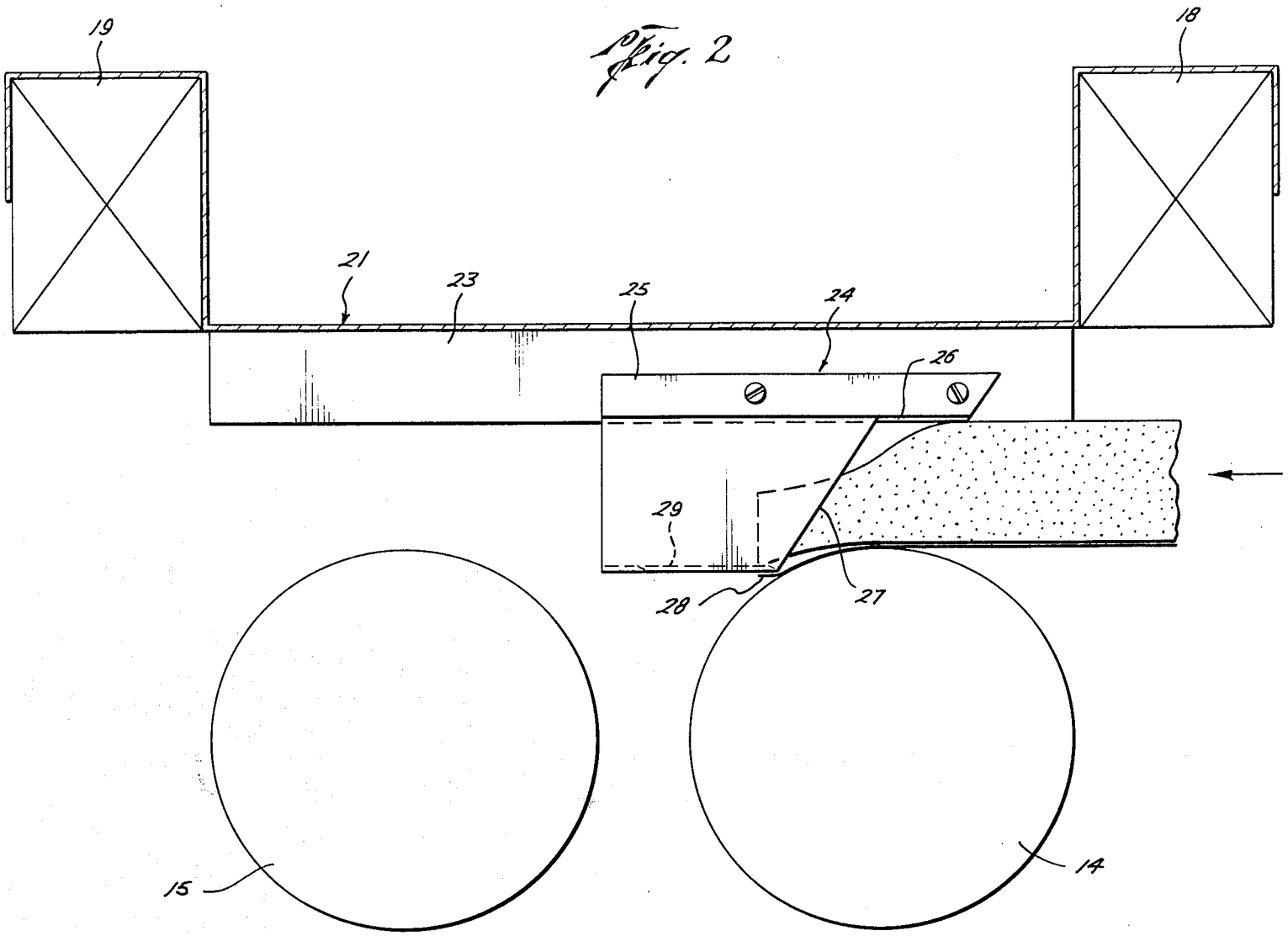
FIG. 2 is a fragmentary view on an enlarged scale from the opposite side of the knife holder as viewed in FIG. 1 showing the front edge of the board being cut to be bent downwardly so that the foil will extend beneath the knife.

As best shown in FIG. 2, the first cutting edge 27 has a negative rake. That is, it extends at an acute angle to the tangential plane across the pair of support rollers on the feed side of the machine which in FIG. 2 is the right side of the drawing. As the front edge of the insulating board engages the first cutting edge 27, the negative angle of the blade results in a component of force acting downwardly on the insulating board. Some insulating boards have their leading edges compressed as shown in the drawings and others do not. In either case, it will be found that the blade 27 will result in a downward component of force on the leading edge of the board which will bend it downwardly. The blade height will be adjusted such that the lower extremity of blade 27, while below said tangential plane will be above the leading edge of foil 28 when the leading edge of the insulating board reaches the extreme lower end of the first cutting edge 27. The blade edge 27, while sharp enough to cut the fiberglass, is not sharp enough to cut the foil under the forces involved and even if the board is not bent down to the lower end of blade edge 27, the foil will ride down the blade edge and be separated from the remainder of the board so that it may pass below the knife means. This is particularly true when the edge of a board has been damaged.

The blade means has a second cutting edge 29 which extends in a plane substantially parallel to said tangential plane and, as viewed in the drawings, the blade 29 extends horizontally. This second cutting edge 29 is positioned below a plane tangential to the crest of rollers 14 and 15. If the blade has a substantial length cutting edge, it should also have a negative rake. That is, it should extend rearwardly of the machine from its juncture with the first cutting edge 27 toward its free end 29A. This configuration will permit the foil to easily slip below the blade as the insulating board moves forward and engages progressive segments of the second cutting edge 29. Of course, if the horizontal extent of this blade is small, the foil will be below the blade as shown in FIG. 2 and the negative rake angle would not be needed. It is also, of course, apparent that if other means than the negative rake angle of the first cutting edge 27 were utilized to temporarily bend the board downwardly at the beginning of the cut across the width of the knife, then no negative rake angle would be needed on any section of the blade.

Figure 3:
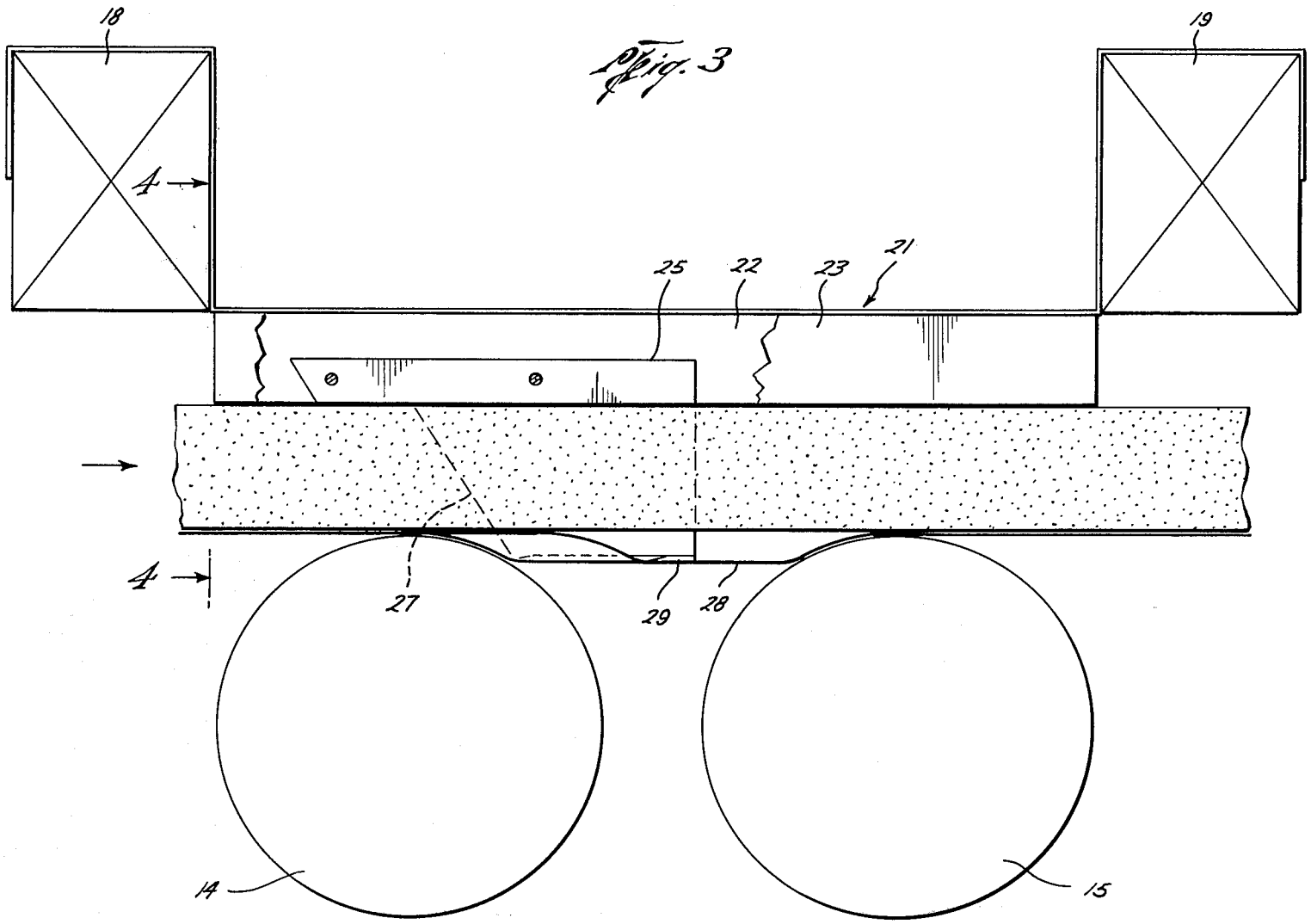
FIG. 3 is a fragmentary view similar to FIG. 1 on an enlarged scale illustrating the manner in which the barrier, such as foil, is removed from the strip of matted fiberglass thereabove.

FIG. 3 illustrates the action of the second cutting edge 29 of the blade in shearing the foil 28 free from the remainder of the insulating board. As illustrated, the board is held between the support rollers 14 and 15 and the sleds 22 and 23 as it passes through the machine. The support is such that the insulating material is not bent downwardly by the negative rake angle of the first blade section 27 and the second blade section 29 is thus positioned below the matted fiberglass portion of the insulating board. As the foil barrier 28 moves below the blade, there results a shearing action in which the foil is sheared from the remainder of the board as illustrated in FIG. 3.

Substantially all of the glass material which might remain adhered to the foil section 28 is scraped therefrom by the cutting edge of the second section 29 of the cutting blade.

In known prior forms of board cutting machines, such as the Barr Patent, the blade has acted to cut through the fiberglass immediately adjacent to the foil when it was desired to leave a clean piece of foil. So far as is known, this is the first instance in which a foil is literally peeled from the insulating board instead of being cut as in prior known machines.

In practicing the method of this invention, the insulating board to be cut is placed on the support table 17 and introduced between rollers 10 and 11. The rollers are then activated to drive the insulating board through the machine. The board moves along a plane tangential to the crest of rollers 14 and 15 until it meets the negative rake of the first blade section 27. This blade section not only cuts the insulating material, but also acts as a means to bend the foil down and also, in many instances, bends the leading edge of the board downwardly, as viewed in the drawings, until the impermeable barrier is below the blade as shown in FIG. 2. As noted above, these means might be utilized to temporarily bend the leading edge of the board downwardly until the foil 28 is below the blade. As the insulating board moves on through the machine, it returns to its unbent condition and the second support rollers 15 insures that the board continues across the machine in the proper plane. Thus, while the beginning cut at the end of the board is more in the nature of cutting as in the past, as soon as the insulation board is forced to return to its unbent condition, as shown in FIG. 3, the remaining action of the second blade section 29 is a stripping one in which the foil is peeled from the insulating board.

It will be appreciated that while the cutting edges of the blade means have been sharpened, they are not sharpened to a fine edge so that the blade edge 27 is capable of bending the insulation board down, and if the foil 28 happens to engage blade section 27, the foil will ride downwardly on the blade and be stripped from the fiberglass material. In other words, the blade 27 is not sharp enough to cut through the foil in the event the foil engages the blade if the blade is properly set. Also, the cutting edge section 29 is not sharp enough so that it will cut through the barrier 28 as it passes below the blade, but will act in a shoveling manner to scrape therefrom any insulating material remaining adhered to the foil.

The blade should preferably be provided with an adjustable mounting on the blade carrier (not shown). This will permit the machine to be used with insulating board of different densities and different compositions. While the blade cutting edge 29 will always be below a plane passing through the crest of the support rollers 14 and 15, the height of the blade section 29 will need be adjusted vertically to accommodate boards manufactured by different companies.

In processing some boards, it may be found that there is slight, if any, downward bending of the fiberglass material due to the negative rake of the blade section 27. In such event, the foil 28 will be forced downwardly by the blade edge 27 so that it passes below the second blade edge 29. In this case, there would be no initial cutting action and the entire action of removing the foil from the insulating board would be a shearing action in which the foil is forced below the blade and stripped from the remainder of the insulating board.

The blade disclosed in the instant application is the blade utilized as a part of the system to remove the insulating material from an end edge of the board and provide a "stapling flap". In the illustration, the stapling flap cut is made at a side edge of the insulating board. If such cut is to be made other than at the extreme side edge of the board, then a second blade (not shown) would be utilized to follow the blade 24 and cut off the side edge of the entire insulation, including the impermeable barrier 28.

The foregoing disclosure and discription of the invention is illustrative and explanatory thereof and various changes in the size, shape, material and method, as well as in the details of the illustrated construction may be made within the scope of the appended claims without department from the spirit of the invention.

What is claimed is:

1. An insulating board cutting machine comprising,
means for driving a board through the machine,
spaced board guide means guiding a board to be cut along a plane touching each guide means, blade support means on the side of said plane opposite the board guide means,
and blade means carried by said blade support means,
said blade means having a first cutting edge extending from the blade support means past said plane and into the space between said board guide means,
said first cutting edge extending at an acute angle to said plane on the feed side of the machine,
said blade means having a second cutting edge extending from the end of said first cutting edge in a plane substantially parallel to said first mentioned plane.

2. The machine of claim 1 wherein means are provided for holding a board being cut against said board support means.

3. The machine of claim 1 wherein the blade support means holds a board being cut against said board cutting means.

4. An insulating board cutting machine comprising,
means for driving a board through the machine,
a pair of spaced rollers guiding a board to be cut along a plane tangent to both rollers,
blade support means on the side of said plane opposite said rollers,
blade means carried by said support means,
said blade means having a first cutting edge extending from the support means past said plane and into the space between said rollers,
said first cutting edge extending at an acute angle to said plane on the feed side of the machine,
said blade means having a second cutting edge extending from the end of said first cutting edge in a plane substantially parallel to said tangential plane.

5. The machine of claim 4 wherein means are provided for holding a board being cut against said rollers.

6. The machine of claim 4 wherein the blade support means holds a board being cut against said rollers.

* * * * *